United States Patent [19]

Helbawi

[11] Patent Number: 4,953,682

[45] Date of Patent: Sep. 4, 1990

[54] AUTOMATIC REVERSE VENDING MACHINE FOR ALUMINUM CAN RECYCLING

[76] Inventor: Salah Helbawi, 49 De La Moselle, St. Lambert, Quebec, Canada, J4S 1W1

[21] Appl. No.: 342,803

[22] Filed: Apr. 25, 1989

[51] Int. Cl.[5] ..... G07F 7/06

[52] U.S. Cl. ..... 194/208; 194/212; 100/902

[58] Field of Search ..... 194/205, 208, 209, 212; 100/902

[56] References Cited

U.S. PATENT DOCUMENTS

| | | | |
|---|---|---|---|
| 3,907,087 | 9/1975 | Tanaka | 194/209 |
| 4,241,821 | 12/1980 | Wu et al. | 100/902 X |
| 4,436,026 | 3/1984 | Imamura et al. | 100/45 |
| 4,454,028 | 6/1984 | Vetter et al. | 194/212 X |
| 4,512,253 | 4/1985 | LaBarge et al. | 194/212 X |
| 4,532,859 | 8/1985 | Solordal | 194/212 X |
| 4,653,627 | 3/1987 | Hampson et al. | 194/209 |
| 4,667,593 | 5/1987 | Kennedy | 100/215 |

FOREIGN PATENT DOCUMENTS

| | | | |
|---|---|---|---|
| 3604763 | 9/1986 | Fed. Rep. of Germany | 100/902 |
| 2169838 | 7/1986 | United Kingdom | 100/902 |

*Primary Examiner*—Joseph J. Rolla

*Attorney, Agent, or Firm*—Larson and Taylor

[57] ABSTRACT

An apparatus crushes aluminum cans at a fast rate and dispenses compensation for the crushed cans. The apparatus crushes the cans on the longitudinal axis rather than lengthwise which results in a more compact unit thus saving storage space. The apparatus also processes the cans faster than most existing machines. The apparatus comprises an enclosure with an opening for receiving cans leading to a chute for the cans to fall one at a time with the cylindrical axis substantially vertical. A dispenser releases one can at a time from the chute past a detector to reject any cans that are not aluminum, through a gate which closes and permits a platen to crush the can on the closed gate. The crushed can is ejected into a discharge container and compensation commensurate with the number of cans processed is issued.

17 Claims, 9 Drawing Sheets

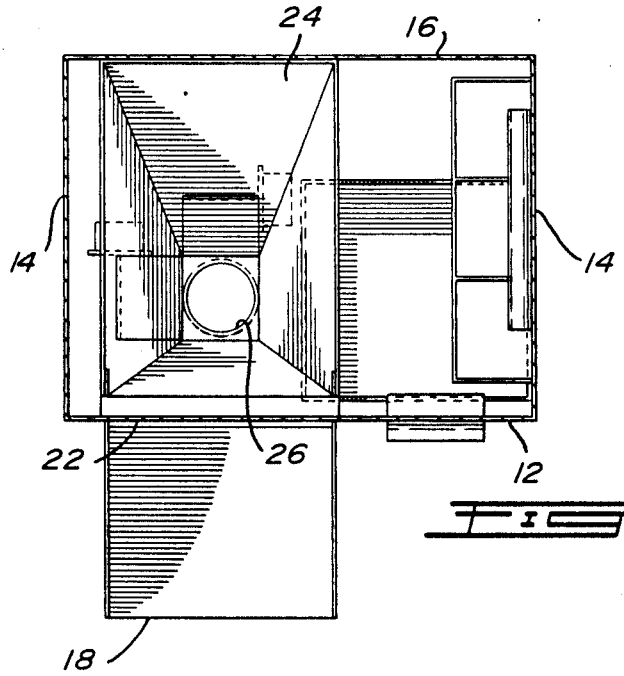
FIG. 3
FIG. 5
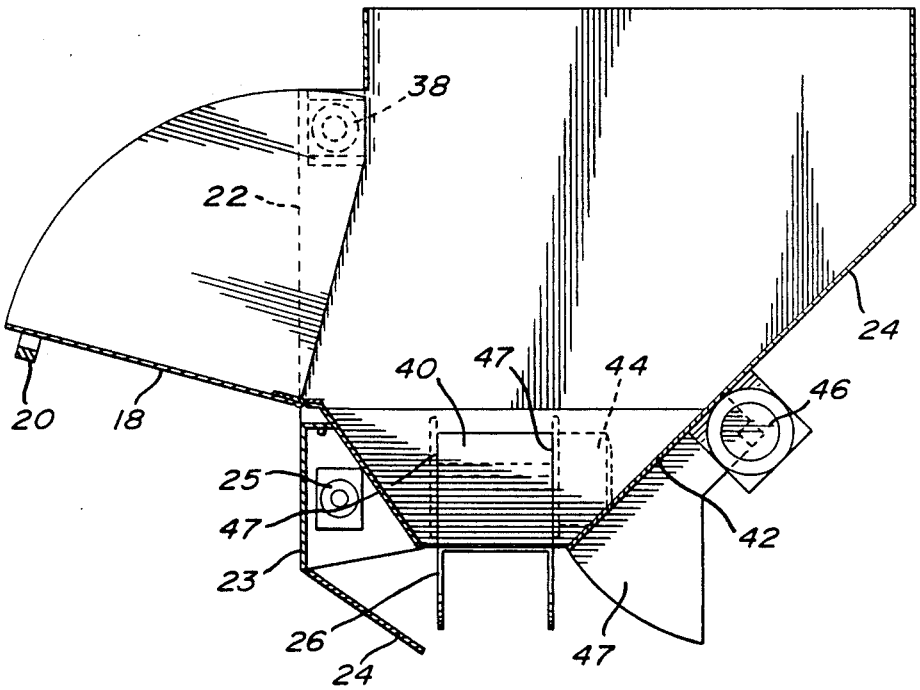

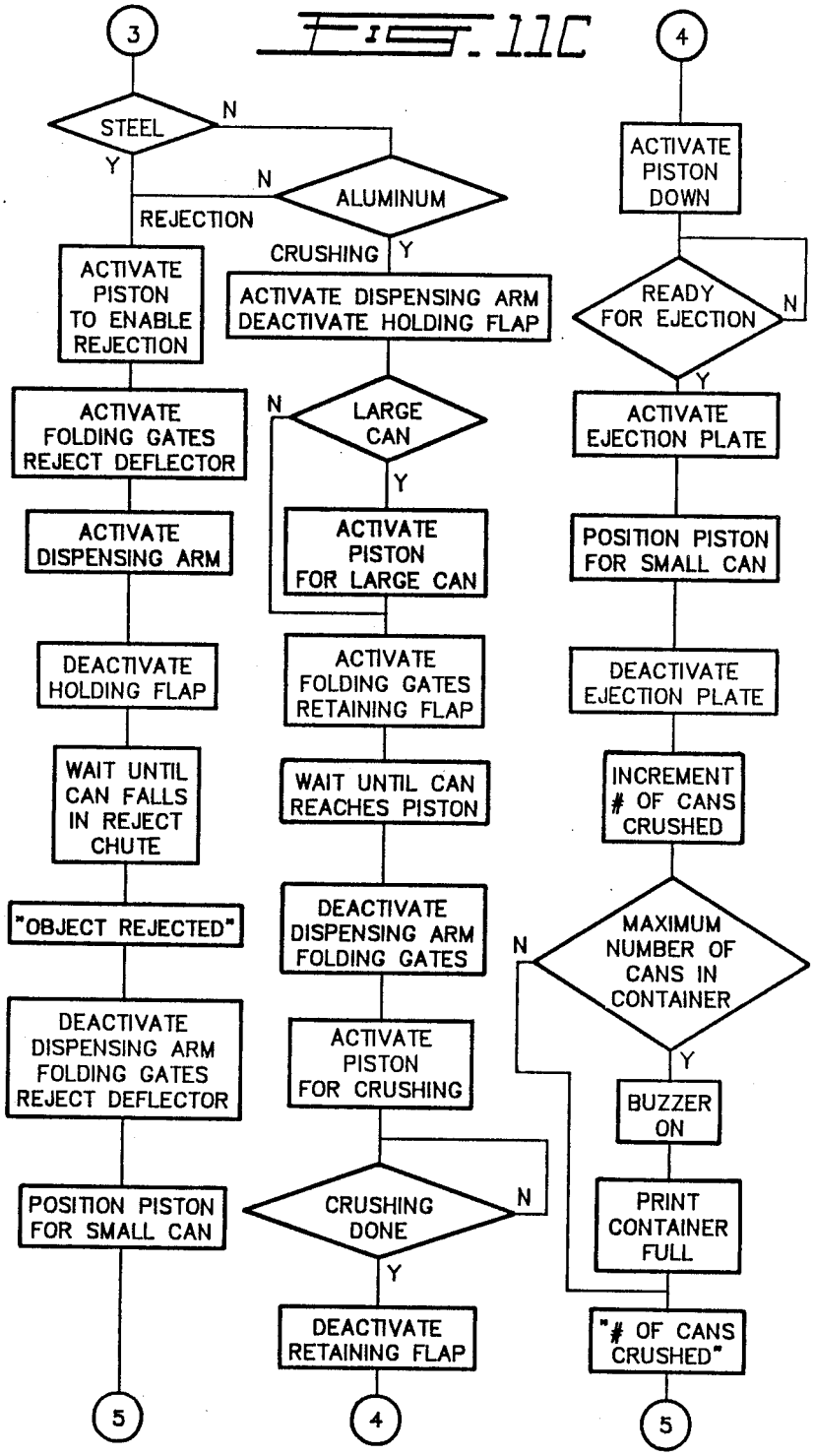
FIG. 11C
3
STEEL
N
Y
REJECTION
ALUMINUM
N
CRUSHING
Y
ACTIVATE PISTON TO ENABLE REJECTION
ACTIVATE DISPENSING ARM DEACTIVATE HOLDING FLAP
ACTIVATE FOLDING GATES REJECT DEFLECTOR
LARGE CAN
N
Y
ACTIVATE DISPENSING ARM
ACTIVATE PISTON FOR LARGE CAN
DEACTIVATE HOLDING FLAP
ACTIVATE FOLDING GATES RETAINING FLAP
WAIT UNTIL CAN FALLS IN REJECT CHUTE
WAIT UNTIL CAN REACHES PISTON
"OBJECT REJECTED"
DEACTIVATE DISPENSING ARM FOLDING GATES
DEACTIVATE DISPENSING ARM FOLDING GATES REJECT DEFLECTOR
ACTIVATE PISTON FOR CRUSHING
POSITION PISTON FOR SMALL CAN
CRUSHING DONE
N
Y
DEACTIVATE RETAINING FLAP
5
4
4
ACTIVATE PISTON DOWN
READY FOR EJECTION
N
Y
ACTIVATE EJECTION PLATE
POSITION PISTON FOR SMALL CAN
DEACTIVATE EJECTION PLATE
INCREMENT # OF CANS CRUSHED
MAXIMUM NUMBER OF CANS IN CONTAINER
N
Y
BUZZER ON
PRINT CONTAINER FULL
"# OF CANS CRUSHED"
5

AUTOMATIC REVERSE VENDING MACHINE FOR ALUMINUM CAN RECYCLING

The present invention relates to an apparatus designed to receive aluminum cans, crush the cans at a fast rate and dispense compensation for the crushed cans. More specifically, the apparatus receives a batch of aluminum cans crushes the batch of cans and then dispenses a receipt or money commensurate with the number of aluminum cans in the batch. Aluminum cans may be fed one can at a time into the apparatus.

Recycling of aluminum beverage cans is an important factor in the emphasis that has been occurring in recent years in energy conservation and environmental protection. Initially devices known as reverse vending machines were produced to crush aluminum cans and give compensation, either a receipt or cash, based on the weight of aluminum. Many of these devices are large and bulky, they generally are located outside, often in car parks and the like, and take up the space of a parked car. Most of these devices take large batches of cans and crush them up lengthwise. Although, there is good financial return in waste aluminum, many people are not motivated to use these devices. These devices are costly and also due to their lack of use, they have not proven to be economically viable.

Governments have stepped into the field of environmental protection and have promoted a deposit to be paid on each aluminum beverage can. Small indoor reverse vending machines are presently available, but they mostly receive aluminum cans on a one can at a time basis, and process them slowly. If one has a large number of cans, then they must be fed into the machine one at a time, and this has proven unsatisfactory as it takes too long, and people do not bother to return the cans which does not solve the recycling and environmental protection requirements.

It is an aim of the present invention to provide a small indoor reverse vending machine that receives aluminum cans either one at a time or in bulk, and processes a batch of cans at a high rate dispensing a printed receipt or cash automatically commensurate with the number of cans in the batch. It is a further aim to provide a machine that crushes each aluminum can from top to bottom, leaving a compacted can with the top and bottom virtually unchanged. This feature allows a recognition mark to be placed on the top or bottom of an aluminum can, so the crushed can can be identified, either automatically or manually.

The present invention provides an apparatus for receiving aluminum cans either one at a time or in bulk, wherein aluminum cans can be tipped into a machine where the cans are processed at a high rate and then money or a receipt is dispensed automatically commensurate with the number of aluminum cans in the batch. The cans are processed at a faster rate than existing types of machines. Thus long waits for returning cans are avoided.

The present invention provides a machine that receives single cans or batches of different sizes of aluminum cans, rejects the cans that are not aluminum and any other items that may get into the machine. Each aluminum can is crushed end to end to about 5% of it's original height and then is discharged into a discharge container.

The present invention provides an apparatus for receiving aluminum cans, detecting and rejecting ferrous metal and non metal cans or other items, crushing aluminum cans, and providing compensation for the crushed aluminum cans, comprising; a sheet metal enclosure; opening in the front of the sheet metal enclosure for receiving aluminum cans and other items leading to a chute to guide aluminum cans and other items, to fall one at a time with a cylindrical axis of each can substantially vertical; dispensing means at the bottom of the chute to release one aluminum can or other item individually through an aperture in a sole plate under the chute; detector means to detect if a can or other item to be released by the dispensing means is ferrous metal or non metal; reject deflector means to deflect ferrous metal and non metal cans or other items falling through the aperture in the sole plate, to a reject chute; at least one gate with opening and closing means to close on the underside of the sole plate across the aperture; hydraulic cylinder with vertical moving cylinder rod positioned under the sole plate, the cylinder rod having a platen at the top to crush an aluminum can against the closed gate on the underside of the sole plate; ejection plate positioned on top of the platen with pivot means to flip up and discharge a crushed aluminum can into a discharge container at the bottom of the enclosure, and compensation dispensing means for dispensing compensation commensurate with the number of aluminum cans crushed.

In a preferred embodiment, the opening in the sheet metal enclosure for receiving aluminum cans and other items leads to a hopper located in the top portion of the enclosure, the hopper being positioned above the chute. In other embodiments, access is provided from the front of the enclosure for removing and replacing the discharge container, thus permitting the apparatus to be enclosed on three sides and only having access from the front.

In another embodiment, an opening door is provided in the front of the enclosure over a hatchway to receive a batch of aluminum cans and other items and feed them into the hopper. The opening door is preferably hinged downwards and has a solenoid operated lock so that once a batch of cans has been deposited through the hatchway, the door is closed and cannot be reopened until that batch has been processed through the apparatus.

Vibrators are preferably provided to vibrate and shake the aluminum cans and other items in the hopper and ensure they do not jam at the entrance to the chute or in the chute.

In drawings which illustrate embodiments of the invention:

FIG. 3 is a top plan view of the apparatus shown in FIG. 1;

FIG. 5 is a side view of the hopper and door for the apparatus shown in FIG. 1;

Figure 1:
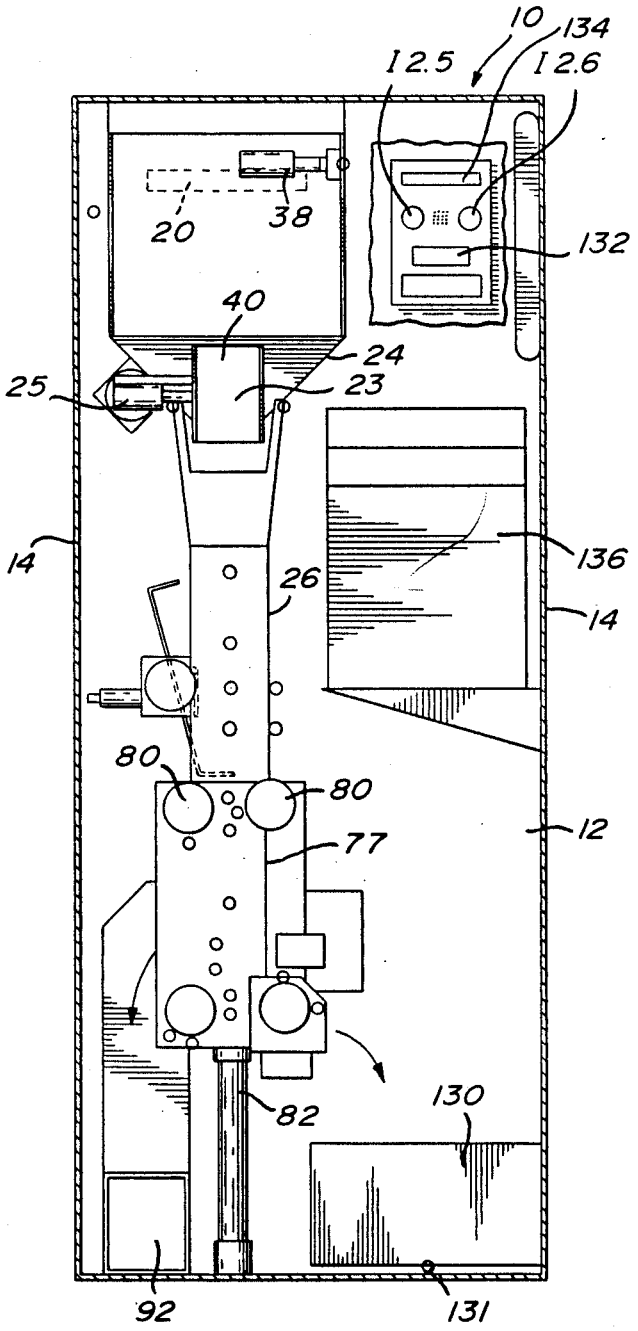
FIG. 1 is a front schematic view of an apparatus for receiving and processing aluminum cans according to one embodiment of the present invention.

The apparatus 10 as shown in FIGS. 1 to 4 has a sheet metal enclosure with a front panel 12, sides 14 and a back panel 16. The apparatus 10 is designed to be operated and serviced from the front panel 12 of the enclosure, thus allowing the apparatus to be installed with the back panel 16 against a wall and the sides 14 adjacent other machines or other equipment.

A hatch door 18 with a handle 20 pivots downwards to provide a hatchway 22 to receive a batch of cans. In one embodiment, up fifty cans can be dropped through the hatchway 22 and the apparatus is designed to process cans at a processing rate of 60 cans per minute. A hand feed door 23 is shown in the front panel 12 beneath the door 18 for cans to be fed into the apparatus one can at a time. For this capacity of apparatus, the size of the enclosure is approximately 2 ft. wide, 1½ ft. deep and 5 ft. high. The machine is designed for indoor use, although if required it may be weather protected.

A hopper 24 is located at the top of the enclosure and has sides which direct the aluminum cans towards a vertical chute 26. The hatchway 22 opens directly into the hopper 24 so that cans fed through the hatchway 22 feed directly into the hopper 24. The hopper 24 has a deep center portion which extends down to the extrance to the chute 26. The hand feed door 23 is positioned to feed cans one at a time into the deep center portion of the chute 26. The hand feed door 23 is an integral part of the hopper 24 and is hinged at the top. A solenoid 25 operates a lock to lock the hand feed door 23 closed when the hatch door 18 is open for processing a batch of cans. A sensor is provided to ensure that the solenoid 25 locks the hand feed door 23 when the hatch door 18 is open.

As shown in FIG. 5, an electric solenoid lock 38 is provided on the door 18 such that when the machine is processing cans, the door 18 is automatically locked and cannot be opened until the batch of cans has been processed. A sensor is activated when the door 18 is open which cuts all power to the apparatus, therefore, the machine does not start operating until the door 18 is closed.

In the deep center part of the hopper 24 there are two reciprocating hinge plates 40 and 42 positioned at two adjacent sides of the hopper 24 at right angles to each other. The plates 40 and 42 are hinged at the top and have rotary solenoids 44, 46 which reciprocates hinge pins. By reciprocating the first hinge plate 40 in and out while the second hinge plate 42 moves out and in, so the two plates are always clear of each other and do not touch or jam, the cans are prevented from jamming together, and are allowed to fall to the entrance of the chute 26 between reciprocations. Side plates 47 are provided on each side of the hinge plates 40 and 42 to prevent cans becoming stuck in the chute or underneath the hinge plates.

Figure 6:
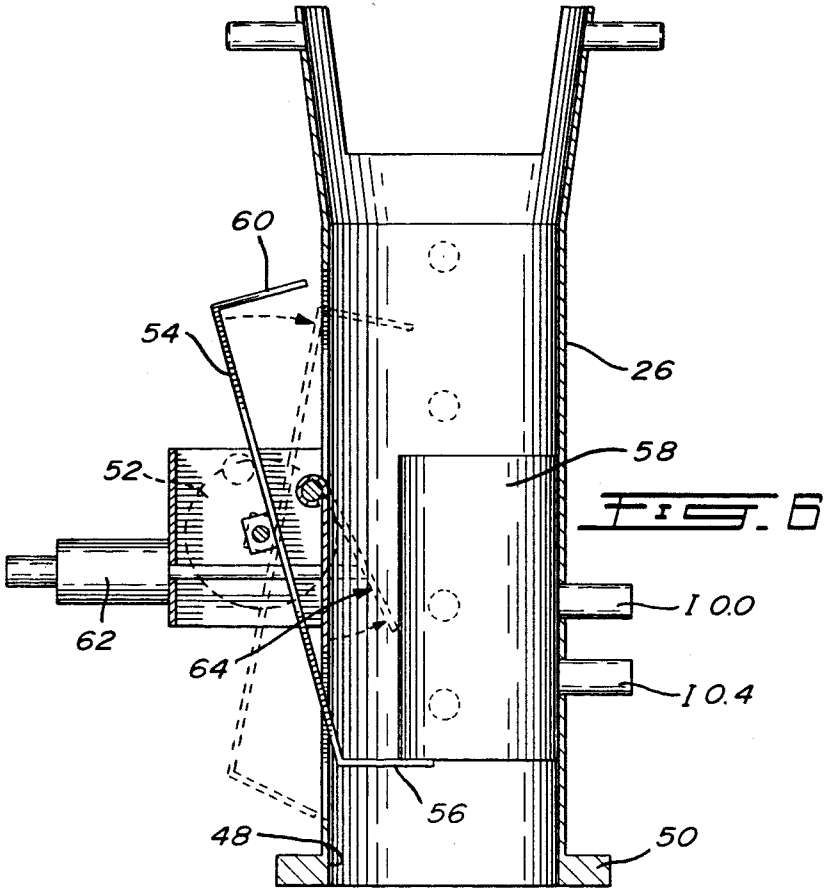
FIG. 6 is a cross sectional side view of the chute and dispensing mechanism for the apparatus shown in FIG. 1.

The chute 26 is shown in detail in FIG. 6. It has a substantially circular funnel shaped top portion leading down to a generally tubular portion extending down to an aperture 48 in a sole plate 50 at the base. A dispensing mechanism is provided at the bottom of the chute 26. A rotary solenoid 52 oscillates a dispensing arm 54 with a lower retaining strip 56 which retains a can 58 in the lowest position of the chute 26. When the can 58 is to be allowed to fall by gravity through the aperture 48 in the sole plate 50, the dispensing arm 54 oscillates releasing the can 58 and a gripping strip 60 grips the can on top of the bottom can 58. To ensure that two cans do not fall at the same time, a solenoid 62 operates an intermediate holding flap 64 which moves out to hold the bottom can 58 against the side of the chute as the arm 54 oscillates to the upper position. The intermediate holding flap 64 releases after the gripping strip 60 holds the next can. Once the can 58 is dropped, the dispensing arm 54 oscillates once again and the next can drops to the lowest position and is held by the retainer strip 56.

The chute 26 is designed to direct all the cans to arrive at the bottom of the chute 26 with their cylindrical axis vertical. The intermediate holding flap 64 together with the gripping strip 60 at the top of the dispensing arm 54 help to push the cans so that they rest against the side of the chute 26. When the can 58 is in the lowest position and is against one wall of the chute 26, if the can is made of metal, an all metal sensor I0.0 is activated. If the can is made of ferrous metal, a ferro magnetic sensor I0.4 is activated. If the metal sensor I0.0 is activated and the ferro magnetic sensor I0.0 is not activated, the can is accepted for further processing as an aluminum can, otherwise the can or other item is rejected.

Sensors are positioned in the chute 26 identified in the drawing by the letter I. Apart from the sensors I0.0 and I0.4 which detect metal and steel, the other sensors are photo electric, proximity, piezo electric or Hall effect. In one case a weight sensor is provided to reject full cans or other objects over a predetermined weight.

A sensor arrangement determines the height of the can. Generally cans fall into two general group sizes although there are several sizes of cans in each group. A size sensor determines the position of the hydraulic piston for the two group sizes so the crushing stroke is kept to the approximate height of the can.

The information from the can size sensor may be used for printing a receipt. In some cases there may be larger compensation for larger cans, and the apparatus determines this information. A sensor is activated when a can has passed into the chute 26 and another sensor indicates when the can has fallen through the aperture 48 in the sole plate 50 so that the dispensing arm 54 can operate to allow the next can to fall into position.

Figure 7:
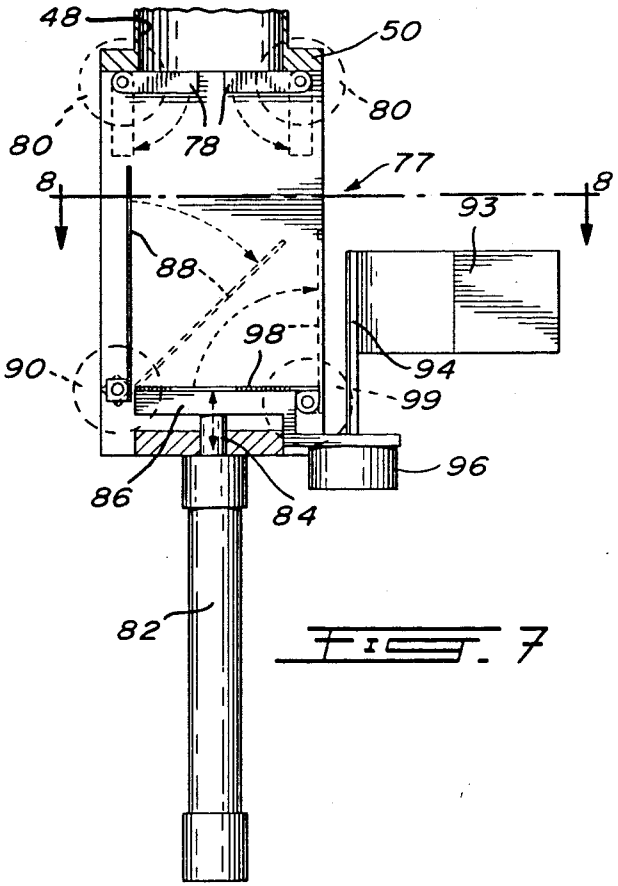
FIG. 7 is a cross sectional side view of the crushing mechanism for the apparatus shown in FIG. 1.

FIG. 7 shows the crushing mechanism 77 with two folding gates 78 operated by rotary solenoids 80 that close upwards against the sole plate 50 to provide a surface for crushing. The gates 78 are supported on the sole plate 50 as the aperture 48 is preferably round and the overall shape of the sole plate 50 is rectangular. The crusher mechanism 77 comprises a hydraulic cylinder 82 as shown in FIG. 1 with a cylinder rod 84 having a platen 86 at the top. The platen 86 moves upwards when the hydraulic cylinder 82 is activated, the platen 86 moves up to compress a can against the closed gates 78.

Figures 2, 8:
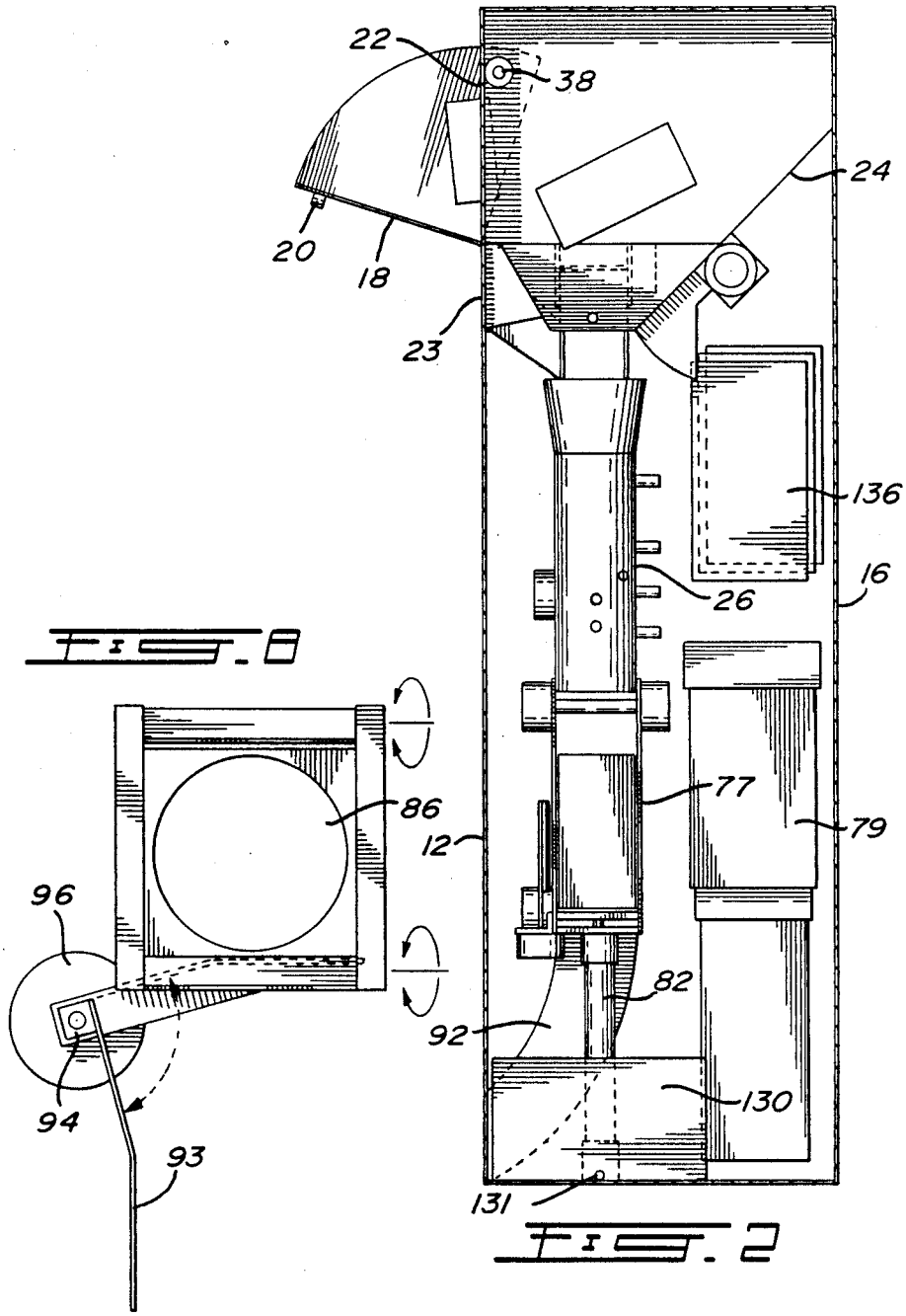
FIG. 2 is a side schematic view of the apparatus shown in FIG. 1.
FIG. 8 is a cross sectional view taken at line 8—8 of FIG. 7 showing the retaining flap.
Figures 4, 9:
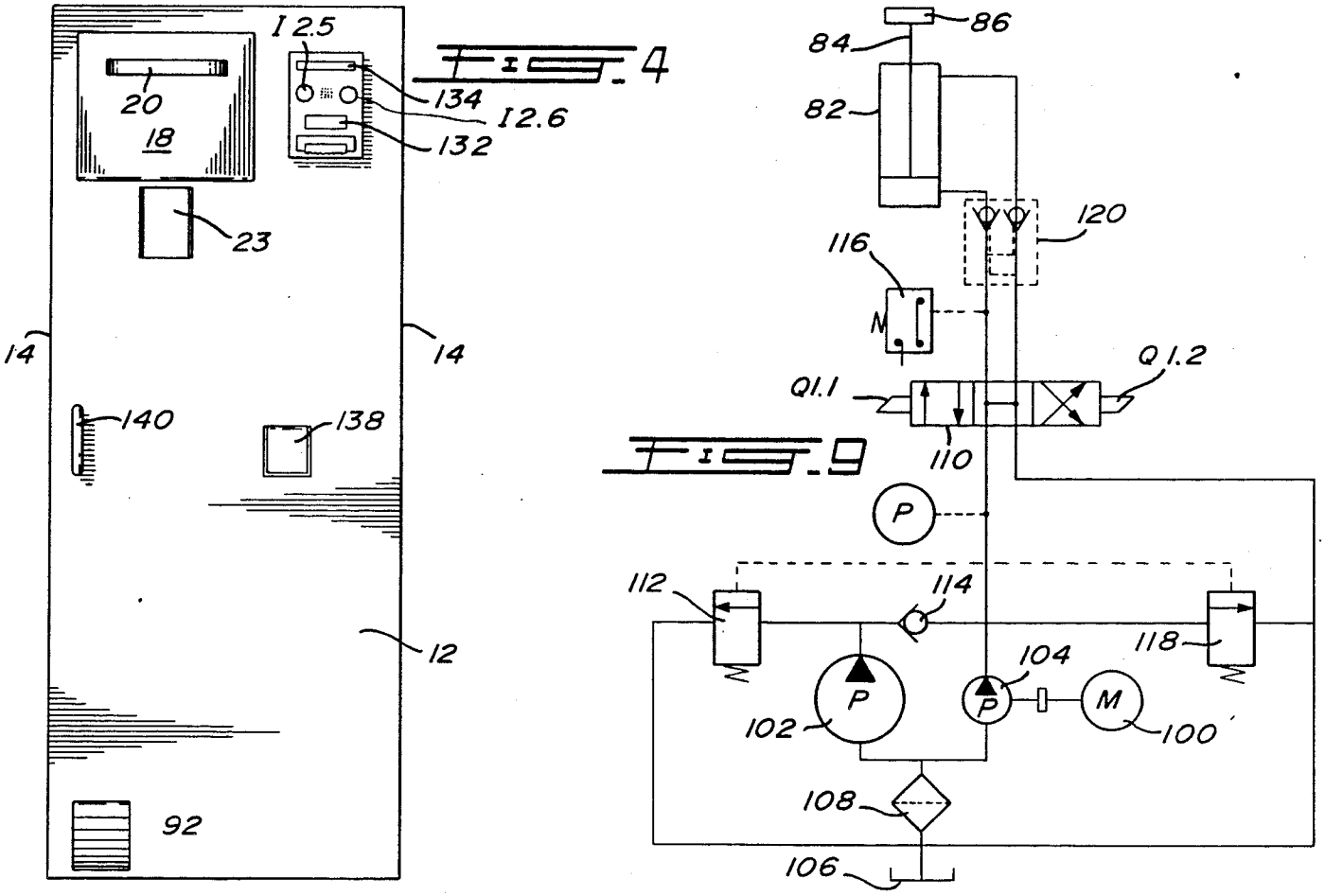
FIG. 4 is a front view of the apparatus shown in FIG. 1.
FIG. 9 is a schematic diagram showing one embodiment of a hydraulic system for the apparatus of the present invention.

FIG. 9 shows the hydraulic power system 79 located as shown in FIG. 2, which has a motor 100 driving a low pressure high volume pump 102 and a high pressure low volume pump 104. Hydraulic fluid from a reservoir 106 passes through a strainer 108 and is initially pumped by pumps 102 and 104 through the open center four way valve 110 operated by solenoids Q1.1 and Q1.2. The cylinder rod 84 is moved upwards in the cylinder 82 until crushing starts, when the hydraulic pressure reaches about 500 psi, a pilot operated unloading valve 112 opens allowing hydraulic fluid from pump 102 only to return to the reservoir 106 and the high pressure pump 104 pumps to raise the pressure to 3000 psi. A check valve 114 prevents the hydraulic fluid passing to the low pressure side of the system. There is a pressure switch 116 which reverses the valve 110 to lower the cylinder rod 84 if the pressure exceeds 3000 psi, there is also a sensor which reverses the valve 110 when the platen 86 is one quarter of an inch from the crushing surface of the two folding gates 78. A pilot operated safety valve 118 is set to release pressure build up in the system over 3250 psi to allow the hydraulic fluid to return to the reservoir 106. Pilot operated double check valves 120 provide a positive locate position of the cylinder rod at any position thus preventing piston drift.

A reject deflector plate 88 is provided at one side of the crusher mechanism 77 operated by a rotary solenoid 90. When the sensors I0.0 and I0.4 have determined that the can or other item is not aluminum, or if other sensors determined the item should be rejected, the reject deflector plate 88 moves across so that a can or other item drops through the aperture 48 in the sole plate 50, and is deflected by the deflector plate 88 into a reject chute 92 as shown in FIGS. 1, 2 and 4 which deposits the rejected can on the floor in front of the apparatus. A reject container may be provided to catch rejected cans if desired. In certain cases it may be desirable to provide a reject container inside the enclosure.

FIG. 8 illustrates a retaining flap 93 positioned at the end of a shaft 94 and operated by a rotary solenoid 96. The retaining flap 93 is located at one side of the crusher mechanism 77 with the rotary solenoid 96 located at a corner and supported by the platen 86 so that as the hydraulic cylinder 82 pushes the platen 86 upwards, the retaining flap 93 moves with it. The retaining flap 93 acts as a locating means so that when a can drops through the aperture 48, it is stopped from bouncing and is held by the retaining flap 93 against the closed reject deflector plate 88. As the platen 86 moves upwards, it passes sensors which deactivate the rotary solenoid 96 to swing the retaining flap 93 out of the way. The retaining flap is cam shaped so that it does not interfere with the crushing of the can against the closed gates 78.

An ejection plate 98 rests on top of the platen 86 and pivots upwards through at least 90° rotatable by a rotary solenoid 99. The ejection plate 98 remains in place during the crushing step and then when the platen 86 returns to its original position, the ejection plate 98 flips up and discharges a crushed aluminum can into a discharge container 130 as shown in FIG. 1. Sensors are provided to show when the ejection plate 28 is flipped up to discharge a crushed can. A weight sensor 131, turns the apparatus off when the container 130 is full. In another embodiment the weight sensor 131 weighs the container 130 before and after a batch of cans is crushed and provides an indication of weight of cans in the batch. This weight figure can then be used for compensation if desired.

Figure 10:
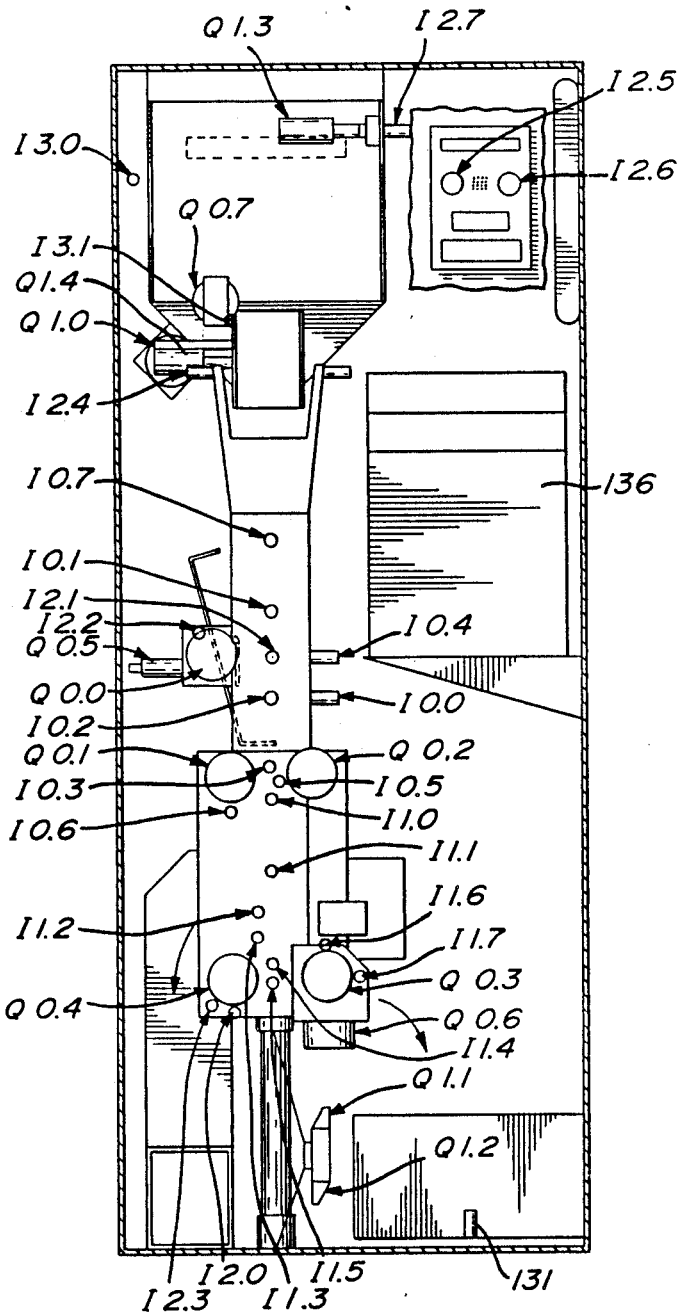
FIG. 10 is a front schematic view of an apparatus similar to that shown in FIG. 1 with the operating solenoids and sensors identified.
Figure 11A:
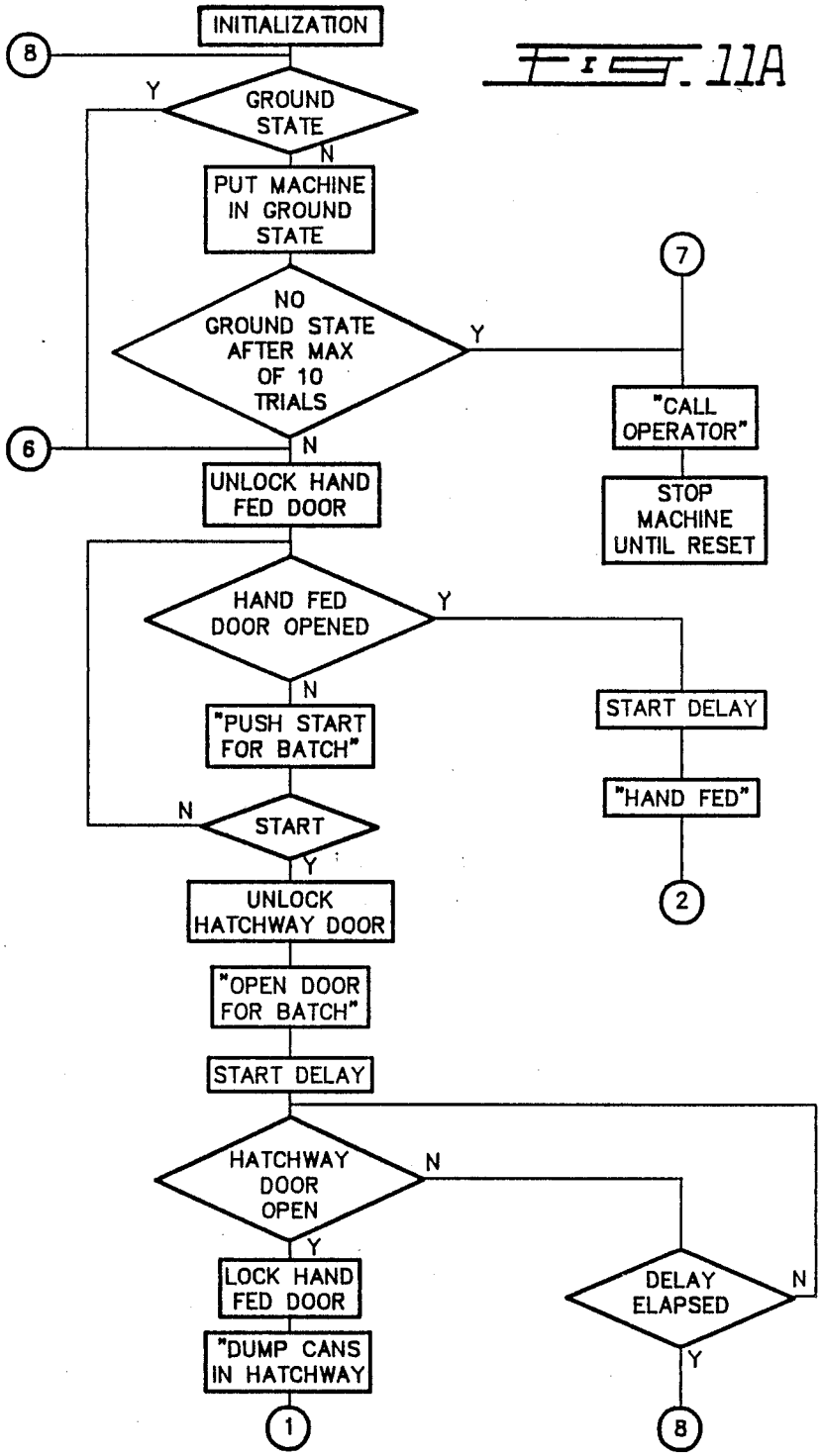
FIG. 11 is a flow chart showing the program logic for processing aluminum cans in the apparatus of FIG. 10.
Figure 11B:
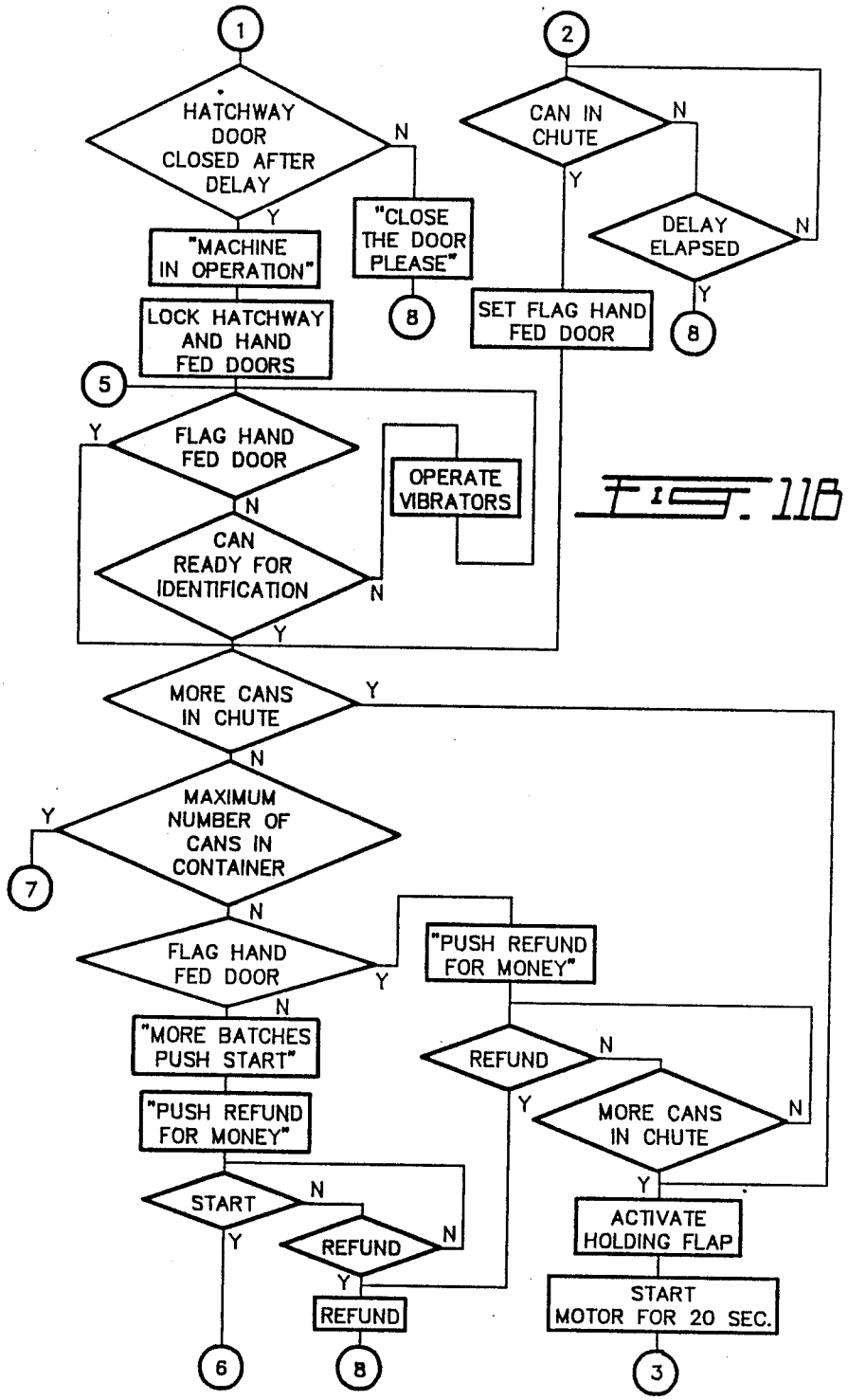

The machine has a central microprocessor control which is programmable, and uses electric solenoids and hydraulic power to feed and crush the cans. Sequences are controlled by the electronic programmable microprocessor. FIG. 10 identifies the sensors on the apparatus by I numbers, and the solenoids by Q numbers. The flow chart shown in FIG. 11 represents a program for the microprocessor to operate the apparatus, I2.5 representing the push button start.

In operation, an operator presses the start button I2.5, opens the door 18 and dumps a batch of cans through the hatchway 22 into the hopper 24. The door 18 is then shut, the solenoid 38 locks the door 18 closed, and the cans start falling into the chute 26. The cans fall one at a time in the chute 26 and are metered by the dispensing mechanism. Rejection is affected automatically if the item is not metal or is ferrous metal. If a can is to be rejected, the gates 78 are opened and the can 58 is released by the dispensing arm 54, the reject deflector plate 88 has moved across so the can is deflected into the reject chute 92. If the sensors to reject are not activated, then the aluminum can drops through the aperture 48 in the sole plate 50 onto the ejection plate 98. The piston 84 moves up from one of two start positions depending on the size of the can, and the can is crushed between the ejection plate 98 and the closed gates 78. Immediately after crushing, the platen 86 moves downward and the ejection plate 98 flips up to deposit the crushed aluminum can into the discharge container 130.

Different size of cans may be processed in this machine. Cans in sizes 280 ml, 355 ml, 476 ml and 946 ml may be processed and crushed at a maximum rate of 60 cans per minute.

A printer 132 on the front 12 of the machine as shown in FIG. 4 provides a printed receipt giving the total number of aluminum cans that have been crushed and a compensation amount for the total number of aluminum cans. Electronic displays 134 show that the machine is functioning. A stop button I2.6 is provided for dispensing receipt or money. A coin dispenser 136 is shown to give change instead of taking a printed receipt to a cashier. Dispensers for one dollar coins, twenty five cent and five cent coins provide change to outlet 138 is shown in FIG. 4.

The controller in one embodiment is programmed to give the correct date and time of day for a particular store name and shows the total number of crushed cans which have been crushed and are in the discharge container 130. The machine stops operating and flashes a signal, "call operator" if the maximum weight capacity of crushed cans is reached. Furthermore, the controller diagnoses failures and flashes the message, "call operator" if the machine does not function. An audible signal is also produced at this time. The machine can be attached by modem to a remote location which receives a signal in case failure develops. A built in rechargeable accumulator provides power so the memory is not wiped out. The memory can be maintained intact for approximately three years. Provisions are made to program a controller either with a hand held programmer or remotely from a central station.

The machine is basically maintenance free and has a storage capacity of 20 kilograms, approximately 1,000 crushed cans. This weight representing the maximum permissible weight for a person to lift without mechanical aids. The machine is preferably modular in construction, so it is maintained by replacing modules for the different components.

The hopper capacity is approximately fifty cans, thus allowing up to fifty cans per batch, and the cans are processed at about 1 per second. When the discharge container 130 is full, it can be removed from the enclosure 10 by unlocking handle 140 and swinging open the front panel 12, as shown in FIG. 4. The interior walls and bottom of the enclosure are cleaned with a moist cloth before installing a new discharge container 130.

Various changes may be made to the apparatus described herein without departing from the scope of the present invention which is limited only by the following claims.

The embodiments of the invention in which an exclusive property or privilege is claimed are defined as follows:

1. An apparatus for receiving aluminum cans, detecting and rejecting ferrous metal and non metal cans or other items, crushing aluminum cans, and providing compensation for the crushed aluminum cans, comprising:

a sheet metal enclosure;

opening in the front of the sheet metal enclosure for receiving aluminum cans and other items leading to a chute to guide aluminum cans and other items, to fall one at a time with a cylindrical axis of each can substantially vertical;

dispensing means at the bottom of the chute to release one aluminum can or other item individually through an aperture in a sole plate under the chute;

detector means to detect if a can or other item to be released by the dispensing means is ferrous metal or non metal;

reject deflector means to deflect ferrous metal and non metal cans or other items falling through the aperture in the sole plate, to a reject chute;

at least one gate with opening and closing means to close on the underside of the sole plate across the aperture;

hydraulic cylinder with vertical moving cylinder rod positioned under the sole plate, the cylinder rod having a platen at the top to crush an aluminum can against the closed gate on the underside of the sole plate;

ejection plate positioned on top of the platen with pivot means to flip up and discharge a crushed aluminum can into a discharge container at the bottom of the enclosure, and compensation dispensing means for dispensing compensation commensurate with the number of aluminum cans crushed.

2. The apparatus according to claim 1 wherein the opening in the sheet metal enclosure for receiving aluminum cans and other items leads to a hopper located in the top portion of the enclosure, the hopper positioned above the chute, and including opening a door in the opening.

3. The apparatus according to claim 1 including access from the front of the enclosure for removing and replacing the discharge container.

4. The apparatus according to claim 2 wherein the opening door is hinged downwards and has a solenoid operated locking means to prevent it from being opened when the apparatus is in operation.

5. The apparatus according to claim 2 including at least one reciprocating hinged plate at the base of the hopper to ensure cans fall into the entrance of the chute and do not jam at the base of the hopper.

6. The apparatus according to claim 5 wherein the reciprocating hinged plate has side plates to prevent cans falling behind the reciprocating hinged plate, and a rotary solenoid provides reciprocating hinge movement to the plate.

7. The apparatus according to claim 2 including vibratory means in the hopper to vibrate aluminum cans and other items and ensure they do not jam in the hopper.

8. The apparatus according to claim 1 wherein the dispensing means comprises an oscillating arm with a retainer strip at the bottom to retain an aluminum can or other item at the lowest position in the chute, and a gripping strip at the top to retain an aluminum can or other item above the lowest position, and means to oscillate the arm from one position, retaining a can at the lowest position, to the other position, retaining a can above the lowest position.

9. The apparatus according to claim 8 wherein the means to oscillate the arm comprises a rotary solenoid.

10. The apparatus according to claim 8 including an intermediate holding flap to hold the aluminum can or other item in the lowest position when the arm is oscillated from the one position to the other position, and means to apply and release the intermediate holding flap.

11. The apparatus according to claim 10 wherein the means to apply and release the intermediate holding flap is a solenoid.

12. The apparatus according to claim 1 wherein the detector means comprises a first detector to determine if the can or other item is made of metal and a second detector means to determine if it is made of ferrous metal.

13. The apparatus according to claim 1 wherein the gate pivots open in two halves by means of two rotary solenoids.

14. The apparatus according to claim 1 including a retaining flap supported by the platen and moving up and down with the cylinder rod to retain an aluminum can on the platen during the crushing step, the retaining flap having a rotary solenoid to pivot the retaining flap to retain the can and swing the retaining flap aside to ensure it does not interfere with the gate during the crushing step.

15. The apparatus according to claim 1 wherein the reject deflector means comprises a reject deflector plate which tilts under the dispensing means to deflect the other items falling through the aperture to the reject container and a rotary solenoid to tilt the reject deflector plate upon a signal indicating a reject.

16. The apparatus according to claim 1 wherein the hydraulic cylinder is operated by a low pressure pump for fast movement of the cylinder rod and a high pressure pump for the high pressure crushing of the aluminum can.

17. The apparatus according to claim 1 including a hand feed door allowing cans to be fed one at a time and a hatch door allowing cans to be fed into a hopper above the chute, and including means to lock the hand feed door when the hatch door is open.

* * * * *